United States Patent [19]

Lambeth

[11] Patent Number: 4,833,278

[45] Date of Patent: May 23, 1989

[54] INSULATOR HOUSING MADE FROM POLYMERIC MATERIALS AND HAVING SPIRALLY ARRANGED INNER SHEDS AND WATER SHEDS

[75] Inventor: Peter Lambeth, Abinger, Great Britain

[73] Assignee: Hyrdro-Quebec, Montreal, Canada

[21] Appl. No.: 264,400

[22] Filed: Oct. 31, 1988

[51] Int. Cl.[4] ..... H01B 17/32; H01B 17/44; H01B 17/50; H01B 17/54

[52] U.S. Cl. ..... 174/139; 174/140 R; 174/150; 174/178; 174/209; 174/211; 174/212

[58] Field of Search ..... 174/139, 140 R, 140 H, 174/140 CR, 141 R, 150, 142, 178, 209, 211, 212

[56] References Cited

U.S. PATENT DOCUMENTS

| | | | |
|---|---|---|---|
| 2,776,332 | 1/1957 | Von Cron | 174/211 |
| 3,522,366 | 7/1970 | Lambeth | 174/211 X |
| 4,053,707 | 10/1977 | Ely et al. | 174/211 X |

FOREIGN PATENT DOCUMENTS

| | | | |
|---|---|---|---|
| 415783 | 1/1967 | Switzerland | 174/212 |
| 659907 | 2/1987 | Switzerland | 174/209 |
| 899578 | 6/1962 | United Kingdom | 174/178 |
| 1209690 | 10/1970 | United Kingdom | 174/212 |

OTHER PUBLICATIONS

Technical Problems Associated With Developing HVDC Converter Stations For Voltages Above 600 kV–P. C. S. Krishnayya et al; (undated research paper of Institut de recherche d'Hydro–Quebec (IREQ).

Bushings With Silicon Rubber Sheds, F. Hammer et al–Paper No. 44.09 delivered at Fourth International Symposium on High Voltage Engineering, Athens, Greece, 5–9th Sept. 1983.

The Booster Shed: Prevention Of Flashover Of Polluted Substation Insulators In Heavy Wetting–C. H. A. Ely et al., –IEE Transactions on Power Apparatus and Systems, vol. PAS–97, No. 6, Nov./Dec. 1978.

New Insulators With Helicoidal Sheds For Lines And High Voltage Apparatus–L. Gion et al.–Paper No. 208 delivered at the Conference Internationale des Grands Reseaux Electriques à Haute Tension, Paris, 15–25th Jun. 1960 (26 pages).

Booster–Sheds For H.V. Insulators–C. H. A. Ely et al.–Technical Disclosure Bulletin No. 203, CEGB Information Services, dated Feb. 1973, pp. 1–3.

Hollow Composite Insulators For Outdoor Instrument Transformers And Other Equipment–R. Amsinck, (undated) research paper of MWB Messwandler–Bau Aktiengesellschaft.

Resin–Bonded Glass Fibre Outdoor H.V. Insulators–A. W. Stannett et al.–Proc. IEE, vol. 116, No. 2, Feb. 1969, pp. 261–272.

Effect Of Pollution On High–Voltage Outdoor Insulators–P. J. Lambeth et al., Proc. IEE, IEE Reviews, vol. 118, No. 9, R, Sept. 1971, pp. 1107–1130.

*Primary Examiner*—Laramie E. Askin

*Attorney, Agent, or Firm*—Foley & Lardner, Schwartz, Jeffery, Schwaab, Mack, Blumenthal & Evans

[57] ABSTRACT

An insulator housing comprising a resin bonded fibre tube carrying water repellent, spirally arranged inner sheds and water sheds made from strips of polymeric material provides improved outdoor electrical insulation. The insulator housing provides greater insulation performance per unit length of housing than prior art structures.

28 Claims, 8 Drawing Sheets

1
6
22
2
3x
3y
9
23
24

INSULATOR HOUSING MADE FROM POLYMERIC MATERIALS AND HAVING SPIRALLY ARRANGED INNER SHEDS AND WATER SHEDS

BACKGROUND OF THE INVENTION (a) field of invention

The present invention relates to an insulator housing made from polymeric materials.

(b) brief description of the prior art

Electrical insulator housings for outdoor use require certain properties in order to function efficiently. For instance, such housings must provide a creepage (leakage) path greater than overall housing length in order to reduce surface electrical stress across the housing. The higher the voltage across the conductor to be insulated, the longer the creepage path must be in order to prevent flashover (short circuiting).

In polluted areas, a longer creepage path for a given voltage is needed because the surface resistance of the insulator is often lowered by deposits from the air. As a result, the unprotected insulator surface, when wetted by rain, fog or condensation, may become conducting.

For the highest DC voltages currently employed, use of conventional bushing material (porcelain) can be impractical and uneconomical owing to the size of insulator needed (see TECHNICAL PROBLEMS ASSOCIATED WITH DEVELOPING HVDC CONVERTER STATIONS FOR VOLTAGES ABOVE 600 kV by P.C.S. KRISHNAYYA et al, IEEE Transaction on Power Delivery, Jan. 1987, vol. PWRD-2, No. 1, p. 174).

As noted above, conventional bushing housings are prone to flashover due to accumulated pollution on the porcelain sheds. Such housings are subject to aerodynamically-deposited pollution, and also, especially for insulators energized with direct voltage, to electrostaticallydeposited pollution because of the lack of adequate external stress control over their porcelain sheds.

Furthermore, large conventional housing designs suffer from water cascading effects in severe weather, thereby short circuiting the insulation between sheds. In addition, the conventional housings, because of their unitary nature, cannot be altered or adjusted to cope with changing conditions, and if damaged, have to be completely replaced.

The large porcelain bushings of the prior art are also cumbersome, heavy and fragile, requiring their complete production in a factory before transportation to the site of use. Use of porcelain also incurs manufacturing limitations, on the extent to which desirable features, such as long creepage path with well spaced sheds, can be combined.

Various attempts to solve these problems have been made. For example, greasing the insulator surface to increase its hydrophobicity and regular washing of the insulator surface to remove pollution deposits have been tried. Neither method has proved totally successful.

In a paper entitled BUSINGS WITH SILICON RUBBER SHEDS by F. HAMMER & J. WELTGEN, Paper No. 44.09 delivered at the Fourth International Symposium on High Voltage Engineering (Athens, Greece 5–9 Sept. 1983), a hollow composite insulator comprising an inner tube made of glass-fibre reinforced with epoxy resin and an outer sheath comprising silicone rubber sheds, is described.

Although these silicone rubber sheds better inhibit flash-over, the external profile of the bushing described in this paper is substantially that of the conventional porcelain insulators and therefore suffers from many of the disadvantages discussed above for porcelain insulators.

C.H.A. Ely et al, in a paper entitled THE BOOSTER SHED: PREVENTION OF FLASHOVER OF POLUTED SUBSTATION INSULATORS IN HEAVY WETTING, IEEE Transactions on Power Apparatus and Systems, Vol. PAS-97, No. 6, Nov/Dec 1978, disclose the use of supplementary sheds to deflect rain from the more vulnerable parts of insulators. In this paper, skirts of plastic are fixed between the sheds of a conventional insulator so that each skirt overhangs and thereby protects from precipitation the porcelain sheds attached thereunder. The critical amount of pollution deposit, causing insulator flashover at working voltage, in increased when using these skirts or "booster sheds", by a factor of about 4 or 5, i.e. housings with booster sheds can sustain more pollution before flashover occurs.

However, use of booster sheds may actually increase pollution deposits (by preventing rain washing) thereby causing flashover voltage to be undesirably low.

L. Gion et al in a paper entitled NEW INSULATORS WITH HELICODAL SHEDS FOR LIES AND HIGH VOLTAGE APPARATUS, delivered at the Conference Internationale des Grands Réseaux Electriques a Haute Tension, Paris, 15–25th June 1960, disclose how use of helicoidal sheds allows production of shorter insulators of equal efficacy to larger, classical insulators, by taking advantage of the auto-cleaning properties and increased leakage line (=path) inherent in the helicoidal geometry.

However, the insulators discussed in this paper are made of conventional materials (ceramic and porcelain) and therefore still suffer the material deficiencies discussed above.

OBJECTS OF THE INVENTION

In view of the foregoing, it is an object of the present invention to provide an insulator housing which suffers only limited pollution deposition.

It is also an object of this invention to provide an insulator housing made from the most suitable materials for pollution performance.

It is another object of this invention to provide an insulator housing with much longer creepage path than heretofore so that a much higher voltage may be withstood.

It is a further object of the invention to provide an insulator housing using the booster shed principle in combination with the helicoidal shed principle.

SUMMARY OF THE INVENTION

In meeting these and other objects, the present invention provides an insulator housing comprising:

(a) a resin bonded fibre tube having upper and lower ends;

(b) at least one set of inner sheds made up of strips of insulating, water repellent material attached around the tube in a spiral arrangement;

(c) at least one set of water sheds made up from strips of insulating, water repellent material attached around the tube in a spiral arrangement substantially parallel to and outside the inner shed spiral arrangement, wherein the water sheds extend obliquely downwards and outwards from the tube to form a continuous downward sloping surface, so as to shield the inner sheds from precipitation; and preferably (d) a conducting corona shield attached to the upper end of the tube.

The insulator housing according to the invention suffers only limited pollution deposition since air access is restricted. This means that a substantial portion of the surface leakage path of the insulator is extremely well protected from particles or moisture in the atmosphere. The sheds providing this protection are themselves designed to withstand flashover by their shape, giving a long and narrow surface path in series with any discharges, and by the material from which they are made.

The present invention further has the advantage of allowing insulators effective for a given (high) voltage to be manufactured as much smaller items than those of the prior art.

Another advantage of the present invention is that damaged sheds can be replaced in situ without disturbing the body of the insulator, in this case the resin bonded fibre tube. This facility maintains the contents of the tube in the protected environment necessary for its efficient operation. Although access to the tube is thus facilitated, only infrequent replacement is anticipated since the materials are expected to have lifetimes in excess of 10 years even in heavily contaminated areas. A preferred option of a heating system (discussed below) within the housing means that the external surface of the tube does not suffer from condensation and therefore has a projected lifetime of many decades.

A further advantage of the present invention is that the bushing is made up of individual sheds rather than being unitary in nature. This allows construction of the insulator on site instead of in a factory, leading to transportation economies.

Because of the effective modularity of the bushing housing according to this invention, insulator housings may easily be "custom-built" and large insulators, where necessary, may equally be constructed without difficulty. The invention thus provides a cheaper, stronger bushing for UHV DC with a much larger maximum size than is possible with porcelain.

The present invention also has the advantage of not relying on the bonding properties of shed material, thus releasing a wide choice of materials for shed production.

DETAILED DESCRIPTION OF THE INVENTION

The housing according to this invention can be used singly or plurally in combination to form multi-section housings, depending on the voltage to be insulated.

The housing of the invention takes advantage of the materials with the best characteristics for the critical requirements of each individual component.

The resin bonded fibre tube may incorporate any suitable synthetic polymer fibre but glass fibre is most preferred, i.e. resin bonded glass fibre or RBGF.

The resin bonded material has good tensile and flexural strength able to resist a high internal tube pressure. This avoids the need to use brittle materials such as porcelain, for example, which can explode if a crack develops when the inside of the tube is pressurised with gas. Use of the resin-bonded material, according to the invention, thus allows the safer use of gas as internal insulation (leading to a pressurised tube) which is preferable to oil internal insulation, as the latter can lead to dangerous oil fires. The resin bonded material also has a high tensile strength/density ratio to avoid handling and support problems and it can be easily and cheaply fabricated without using expensive moulds. The resin surface of the tube is non-tracking, is resistant to ultraviolet and chemical attack and has low water absorption.

The water sheds may be made from any electrically insulating and hydrophobic material. However, silicone rubber is preferred while PTFE is most preferred.

For the sheds in general the most preferred insulating water repellent material considered to have the best surface characteristics for withstanding pollution flashover because of its hydrophobic qualities is polytetrafluoroethylene (PTFE). Previous use of PTFE has indicated that as a consequence of its hydrophobic characteristic, it is (i) difficult to stick to itself or to a substrate; and (ii) difficult to produce in large complex shapes usually associated with an insulator surface.

To overcome these problems, the polymeric material is, in the present structure, used in strips cut from thin sheets. The strips are then bent into shape and do not rely on either electrical or mechanical properties to be secured.

BRIEF DESCRIPTION OF THE DRAWINGS

The objects, advantages and other features of the present invention will become more apparent upon reading the following non-restrictive description of preferred embodiments thereof, made with reference to the accompanying drawings; in which.

In the following discourse, the same numerical labels refer to all figures, while the numeral (2), for example, may be used to denote collectively items 2*a* and 2*b*, and, similarly, the numeral (3) may be used to denote collectively items 3*x*, 3*y* and 3*z* as well as items 3*a*, 3*b*, 3*c*, etc. The word "distal" is understood to have its usual meaning in relation to the longitudinal axis of the tube.

DESCRIPTION OF PREFERRED EMBODIMENTS

Figure 1:
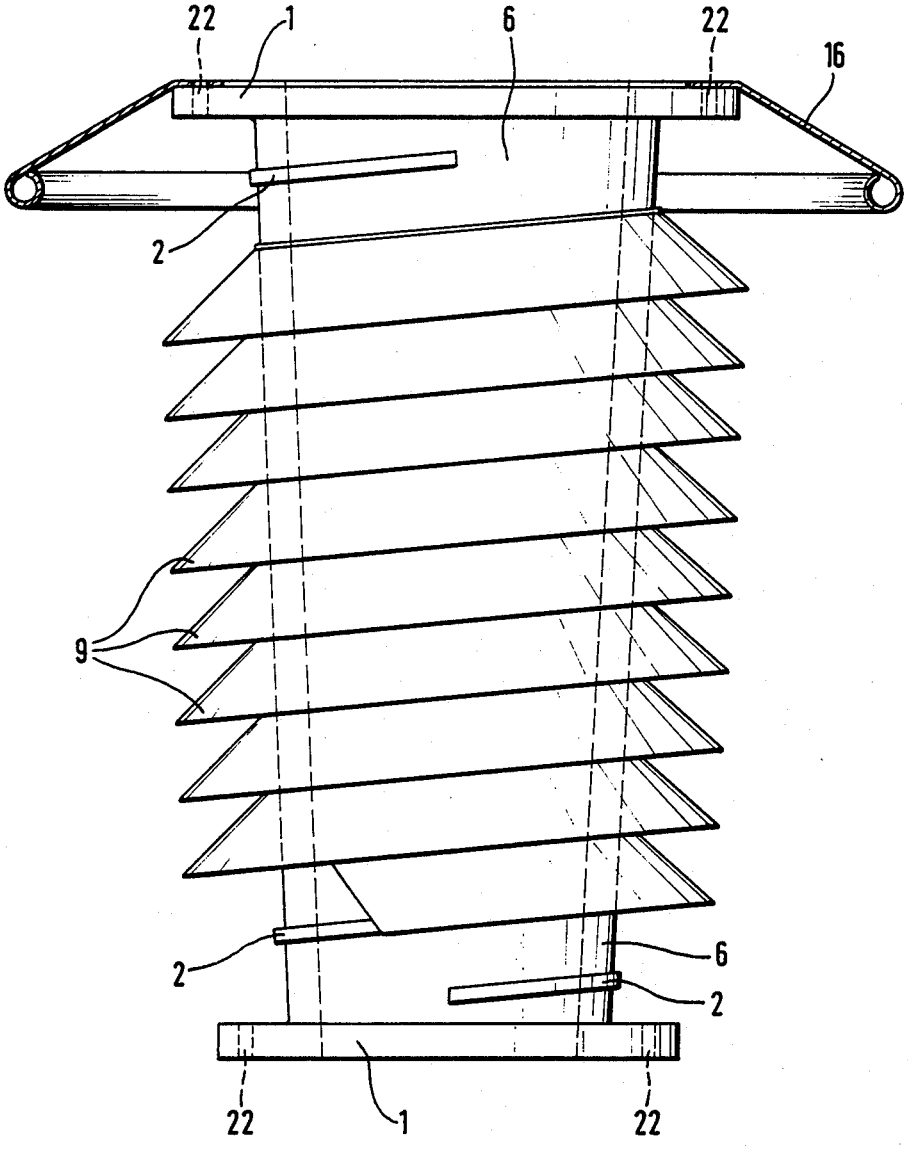
FIG. 1 is a side elevational view, partly in crosssection, of one housing according to the invention.

The insulator housing shown in FIG. 1 comprises a resin bonded fibre tube (6) which may be made by filament winding. This involves rotating a mandrel and winding onto it a filament or bundle of filaments impregnated with a non-track cycloaliphatic resin, or other electrically and mechanically adequate resin. Preferably, a frusto-conical mandrel is used to form a tube which tapers slightly (as is preferred) from top to bottom. Terminal metal flanges (1) may be connected at both ends of the tube (6) using a cement or an adhesive, preferably the resin used to make the tube (6). Alternatively, the flanges (1) may be added during fabrication of the tube.

The tube (6), during its fabrication, has moulded onto it or otherwise attached, single or multi-start, preferably cross-sectionally rectangular, spiral ribs (2) of fibreglass and resin to provide supports for the sheds.

The ribs (2) shown in FIG. 1 are in a single start arrangement, i.e., the ribs (2) form one conical helix. (Multi-start arrangements, which can also be used, lead to a plurality of parallel helices which would also be conical if the tube tapers).

FIG. 1 also shows holes (22) in the terminal flanges (1). These holes (22) allow a plurality of housings to be attached end to end if desired, or to any appropriate surface. Gaskets may be used to provide waterproof seals.

A corona shield (16) is attached to the high voltage (h.v.) end (top end) of the housing and optionally to the h.v. ends of each unit if the housing is made up of individual units stacked upon each other.

Figure 7:
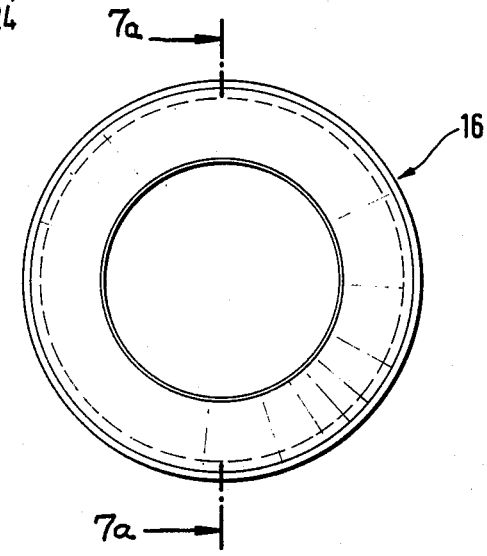
FIG. 7 is a top plan view of a corona shield.
Figure 7A:
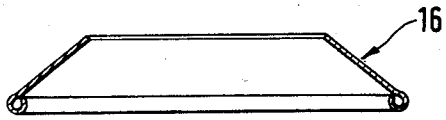
FIG. 7*a* is a side elevational cross-section of the corona shield along the line 7*a*-7*a* of FIG. 7.

The metal corona shield (16) - see also FIGS. 7 and 7*a* serves to improve stress control (in the case of A.C. use), to keep any air flashover arc from the more vulnerable insulating materials, to collect snow and ice, and to ensure that icicles extend well clear of the other sheds. The upper surface of the shield (16) preferably is at the same angle to the housing axis as the water sheds (9) described hereinafter. However the shield is substantially larger than the water sheds (9) and has a turned-over edge to give a toroidal shape free of corona discharge at high voltage. The radius of the toroidal edge is preferably from 20 to 100 mm.

Also visible in FIG. 1 are the water sheds (9). These are of sufficiently large size to protect inner sheds (not visible in FIG. 1) from large quantities of water which could span the air gaps between adjacent inner sheds and cause flashover. The water sheds (9) are similar in principle to the booster sheds described in THE BOOSTER SHED: PREVENTION OF FLASHOVER OF POLLUTED SUBSTATION INSULATORS IN HEAVY WETTING supra, in that they do not provide extra leakage path but simply shed the water well beyond the other more closely spaced inner sheds to avoid cascading water shorting out the gaps between inner sheds.

The water sheds (9) are attached to the spiral ribbing (2) (in a manner described below) so that the water sheds themselves assume a spiral configuration of single or multistart arrangement depending on the arrangement of the ribbing (2). Clearly therefore the angle of descent of the spiraling water sheds (9) is equal to the pitch of the spiral ribbing (2).

Figures 2, 3, 4, 5:
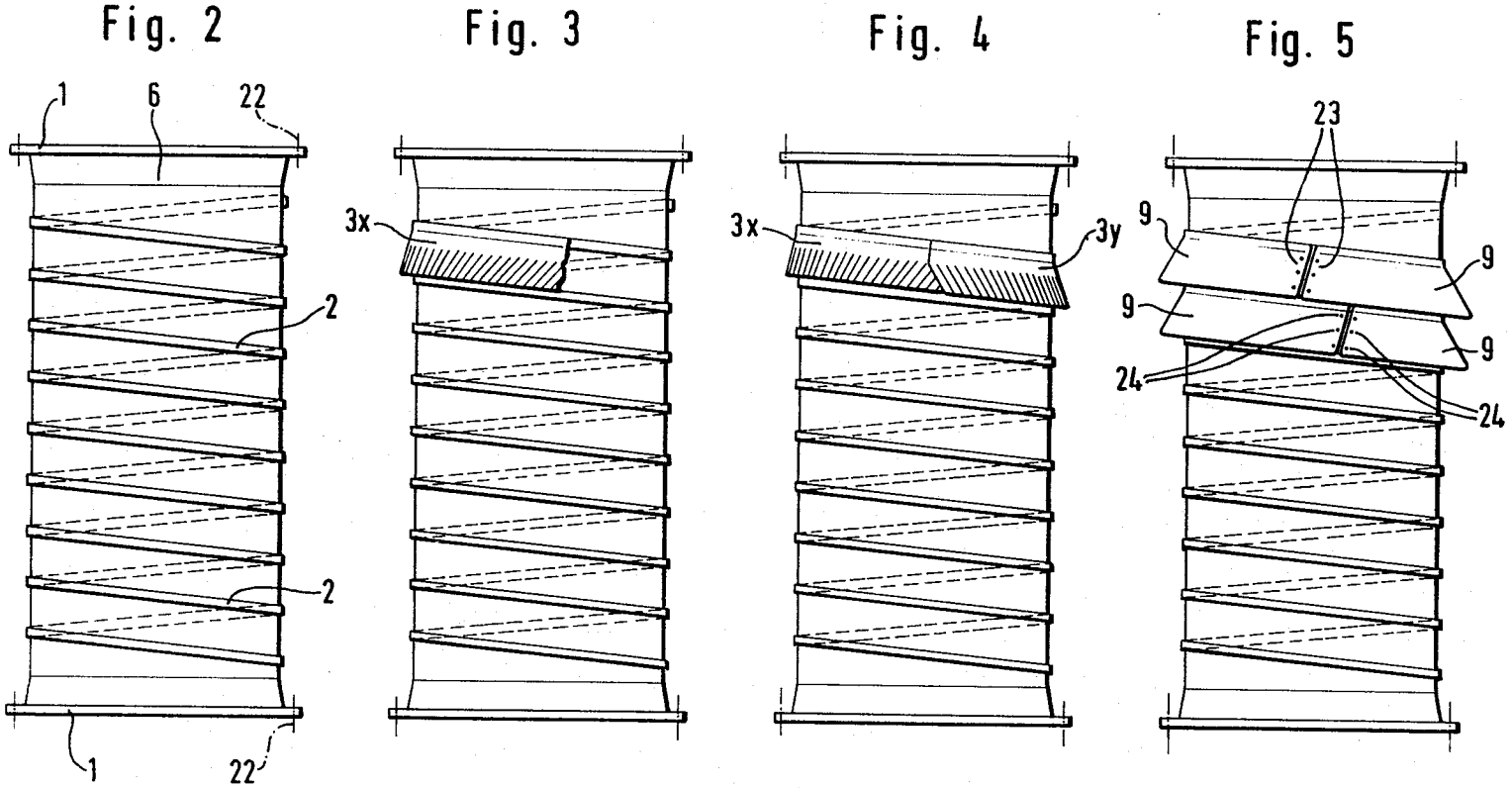
FIG. 2 is a view similar to FIG. 1 showing a cylindrical tube in its naked state.
FIG. 3 shows the tube of FIG. 2 with a cut-away part of an inner shed attached.
FIG. 4 shows the tube of FIG. 3 with a cut-away part of a second inner shed.
FIG. 5 shows the tube of FIG. 4 with a cut-away portion of a water shed attached above the inner sheds.

FIG. 2 shows a cylindrical tube (6) in an "undressed" state, i.e., carrying no sheds, with the pitch of the spiral ribbing (2) reversed from that in FIG. 1 so that in elevation the ribs (2) appear to lose height when travelling from left to right.

The arrangement of ribs (2) is single start in FIGS. 2 to 5, and the tube (6) is cylindrical rather than frusto-conical (as in FIG. 1).

FIG. 3 shows a cut-off portion of a first inner shed (3*x*), attached to the ribbing (2). There may be several sets of inner sheds (3) assuming a single or multi-start arrangement according to the arrangement of the ribbing (2). The inner sheds, like the water sheds, are in a spiral configuration (since they are attached to the ribbing) and are formed from thin strips of polymeric material such as PTFE, which is preferred.

As noted above, more than one set of inner sheds (3) may be employed. In FIG. 4, a second cut-away portion of a shed (3*y*) is seen attached on top of the first shed (3*x*). The attachment is achieved in a manner described below.

The function of these inner sheds (3) is to protect the tube (6) from moisture and pollution, and to provide sufficient "high-quality" (i.e. very clean) leakage path to prevent pollution flashover in light wetting conditions.

As denoted in FIGS. 3 and 4 by close parallel lines, the individual sheds are preferably slotted at their distal ends. This reduces the width of the current path, so that, in the event of a discharge between the end of the shed and the tube or between adjacent sheds or between parts of the same shed, the discharge current is limited.

FIGS. 2 to 5 offer a diagrammatic representation of the steps taken to build up the various layers of sheds. In practice, the first (innermost) set of inner sheds (3x) is attached first before addition of further sets of inner sheds if required. Finally the water sheds (9) are attached.

Figure 6:
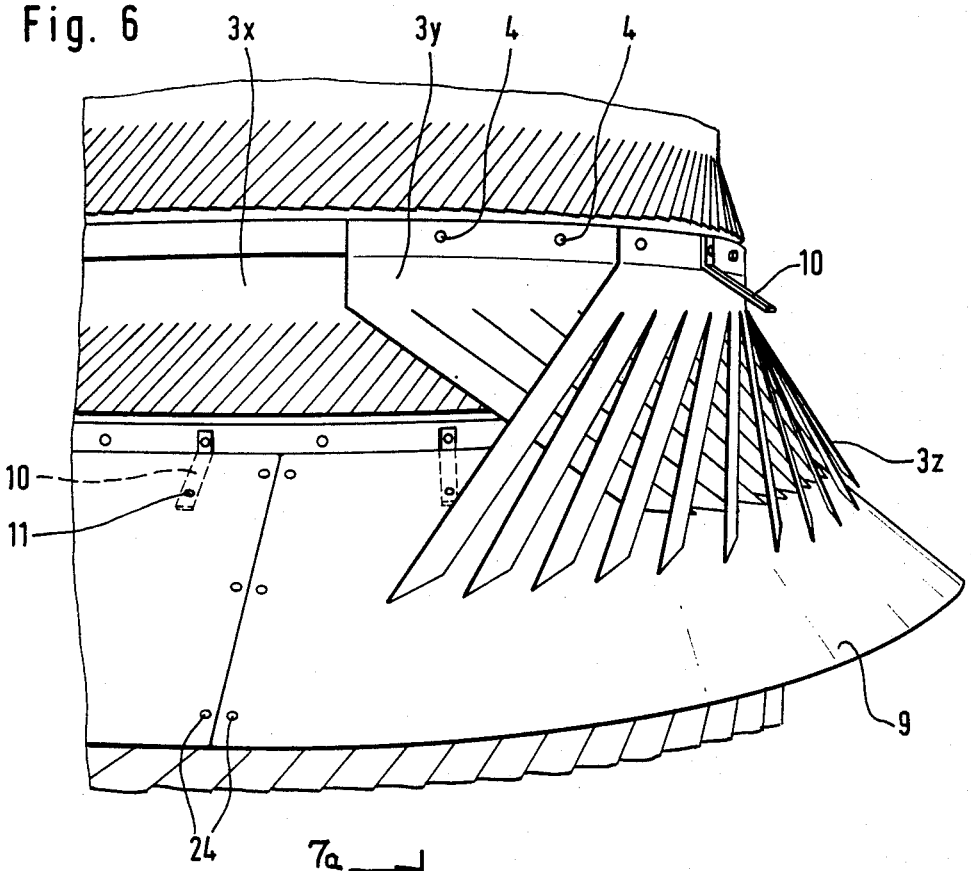
FIG. 6 is an enlarged partial portion of an incomplete housing.

FIG. 6 shows a portion of a housing from which some sheds have been removed for clarity. Three sets of inner sheds (3*x*, 3*y*, 3*z*) are visible as is the water shed (9). the brackets (10) which support the water sheds (9) are partially visible where attached to the water sheds (9) by bolts (11) or similar means. Towards the top right of the drawing a free water shed bracket (10) is visible.

Figure 8:
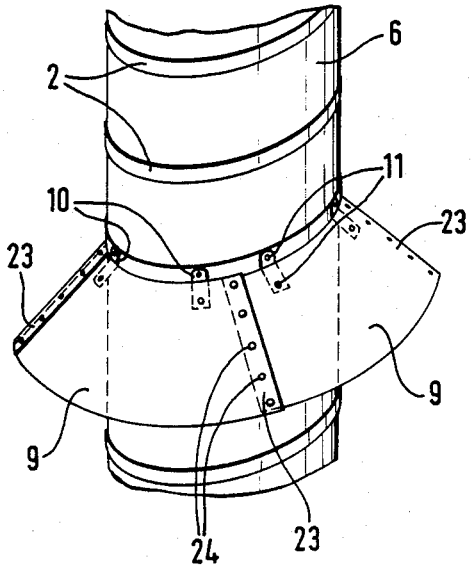
FIG. 8 is a schematic representation of a water shed attachment.

FIG. 8 shows one way of attaching water sheds (9), wherein an angled bracket (10) is attached using conventional bolts to the spiral ribbing (2). The free plate of the angled bracket (10) is then at the correct angle to support the water shed (9) to which it is attached using bolts (11) or similar means. As is apparent in this figure, the water shedding (9) is made up of strips which are joined at overlapping regions (23) by bolts (24) or similar means.

Figure 9:
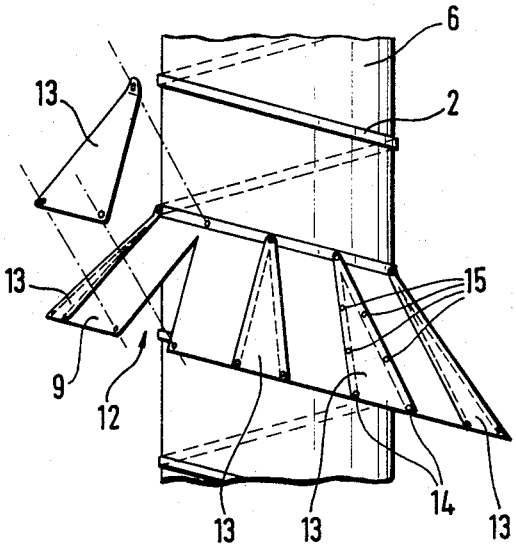
FIG. 9 is a schematic representation of another water shed attachment.

FIG. 9 shows another way of attaching water sheds (9) wherein the strip of insulating material, from which the sheds are made, is cut as shown in the figure, so that the shed can be bent in the form of a spiral of appropriate diameter to fit over the inner sheds (3) and be held onto the spiral ribbing (2).

The resultant space (12) in the shed may be covered by a moulded plate (13) of the same material as the water shed, and held by pegs (14). A similar system has proved extremely successful with booster sheds (see THE BOOSTER SHED: PREVENTION OF FLASHOVER OF POLLUTED SUBSTATION INSULATORS IN HEAVY WETTING supra). This plate (13) may have additional pegs (15) to maintain the correct angle of the space (12) if this is necessary. The water shed (9) is connected to the inner shed (3) surface using brackets (10) -see FIG. 10- thus leaving a gap of 2 mm to prevent build up of electrical stress and thus to ensure there is no electrical puncture of the water shed-/inner shed interface.

The foregoing arrangement of water sheds enjoys inherent perturbations of the shed surface. Thus, rainwater is encouraged to run off the shed surface at frequent intervals where the perturbations occur. If a completely smooth surface is used, serrations or other perturbations in the edges and/or surfaces of the water sheds may be expressly introduced to ensure regularly spaced water run-off points.

The water sheds (9) preferably have an angle of 25°–65° to the axis of the housing, and extend downwardly enough so that the inner sheds (3) are not visible when viewed at right angles to the axis of the tube (6). The pitch in relation to the axis of the tube 96) of the inner and water sheds is the same since both sorts of sheds are attached to the ribbing. However, the shed spacing may be less for the inner sheds since the inner sheds may be multi-start (triple or quadruple), and the water shed single start. Water shed spacing is preferably from 50–250 mm, most preferably from 110–180 mm. ("Shed spacing" in this context means both the insulator housing axial distance between a point on one shed and the corresponding point on the shed next to it, and also the shortest distance between the outer end of a shed and any part of the shed next to it).

When there is only one spiral rib (single start), one or more sets of inner sheds may be attached to this rib. When there are two or more parallel ribs (double or multi-start) again one or more sets of inner sheds may be attached to each rib. Therefore, the degree of spiral start does not necessarily reflect the number of inner shed sets in use.

Figure 10:
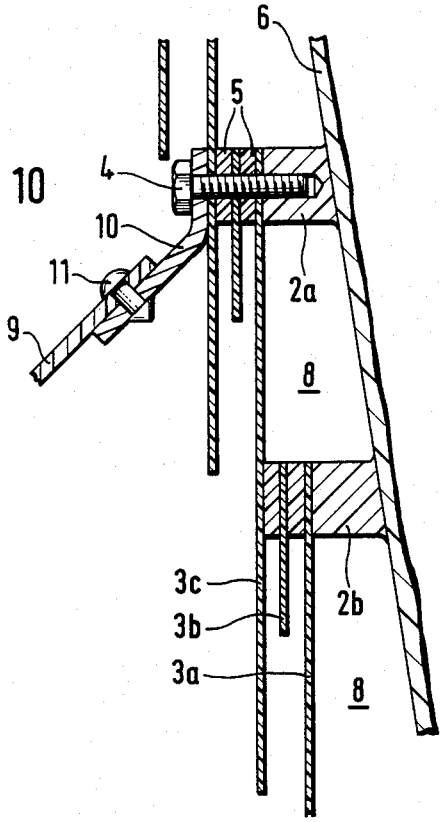
FIG. 10 is a cross-section of one side of a tube to which are attached three sets of inner sheds.

In FIG. 10, a further way of attaching sheds is shown in cross-section. The tube (6) is tapered in this embodiment to form an overall frustoconical shape as seen in FIG. 1. In the figure, the spiral ribs (2) are approximately rectangular in cross-section and may be attached to the tube (6) with adhesive or other suitable means.

In this figure, three sets of inner sheds (3) are shown.

At the point of attachment to the ribbing (2), the sheds (3) are preferably spaced apart by strips (5) of insulating polymeric material, e.g., polypropylene, PTFE or silicone rubber. The figure illustrates two ways of attaching the sheds. At the upper point of attachment, the sheds are supported by bolts or screws (4) driven into the ribbing (2*a*). The second way (visualised in the lower rib (2*b*) of this figure) is simply to glue the sheds (3) and spacers (5) directly to the ribbing (2*b*) using adhesive.

The angle bracket (10) - also seen in perspective in FIG. 8 - is attached to the ribbing (2*a*) outside the combined stack of inner sheds (3) and spacers (5). To aid clarity, neither the bracket nor the corresponding water shed is drawn in on the lower rib (2*b*) in FIG. 10. The bracket (10) is shown attached to the water shed (9) by a bolt (11) or similar. Optionally, the innermost set of internal sheds (3*c*) attached to the upper (see figure) spiral support rib (2*a*) may be extended downwards (i.e. be longer than the other internal shed sets) and attached to the next lower support rib (2*b*) thus forming a sealed volume (8) (open only at the top and bottom of the tube) between the innermost inner shed (3*c*) and the tube (6). This has the advantageous effect of further insulating the tube and protecting it from bad weather.

Figure 11:
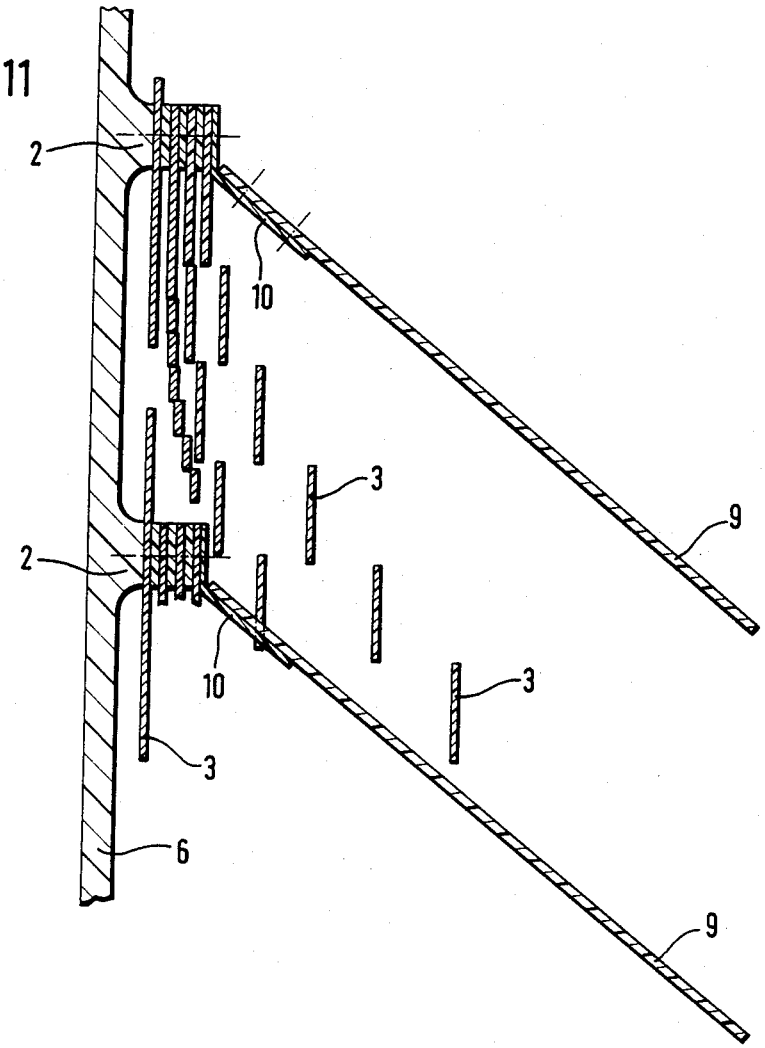
FIG. 11 is a view similar to FIG. 10 showing attachment of four sets of fringed inner sheds.

FIG. 11 shows, in diagrammatic cross-section, how the inner sheds (3) are arranged when their free edges are fringed or slotted. The view is similar to that shown in FIG. 10 but is taken from the other side of an insulator having a cylindrical tube.

Figure 12:
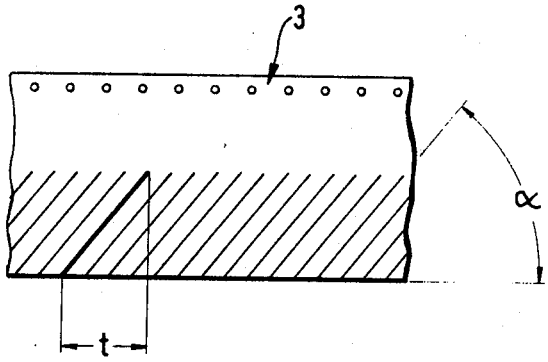
FIG. 12 is a representation of a cut-off portion of a fringed inner shed.

An effective additional screening can be provided by this slotting of the inner sheds. As is shown in FIG. 12, it is preferred that the slotting not be perpendicular to the edge of the strip so that a fringe projects, when the strip of shed material is bent to a curve. This occurs because the slotted portion is no longer constrained to a cylindrical form but instead the individual fringes splay out to become tangential to the tube (see FIG. 6).

Thus, if the flat shed (3) shown in FIG. 12 is bent to a radius, R, radial displacement of the free ends of the fringe from the cylindrical surface of the unfringed part of the shed is $\delta$, $\approx t^2/2R$, where t is the circumferential extent of the fringe. This embodiment can therefore be used to increase the gap between the distal ends of adjacent sets of inner sheds. The angle of slotting may be different on successive layers of sheds as in FIG. 6. Indeed, decreasing the angle a (FIG. 12) on successively overlying sets of inner sheds further increases the separation between the distal ends of each shed set. This increased gap enables the housing to withstand a higher voltage than with unfringed sheds, thereby reducing the risk of flashover.

In addition to the increased air gaps, brought about by fringed edges, the leakage current flowing into each discharge across a gap will be reduced by the high resistance inherent in the fringe geometry. If, instead of sparking at the fringe ends, the gaps spark at the base of the fringes where the air gap is less, the arc will be in series with a high resistance, because the surfaces there are cleaner due to the pollution screening effect of the fringes. The slots dividing the fringes are narrow enough ($\approx$1 mm) to restrict the flow of air to a minimum and so prevent a significant amount of pollution or liquid water from reaching the protected surface, and yet wide enough not to be completely bridged by pollution or water so that any current feeding the main discharge must do so be breaking down this air gap, causing anode and cathode voltage drops and high resistance arc-root current concentrations.

Figure 13:
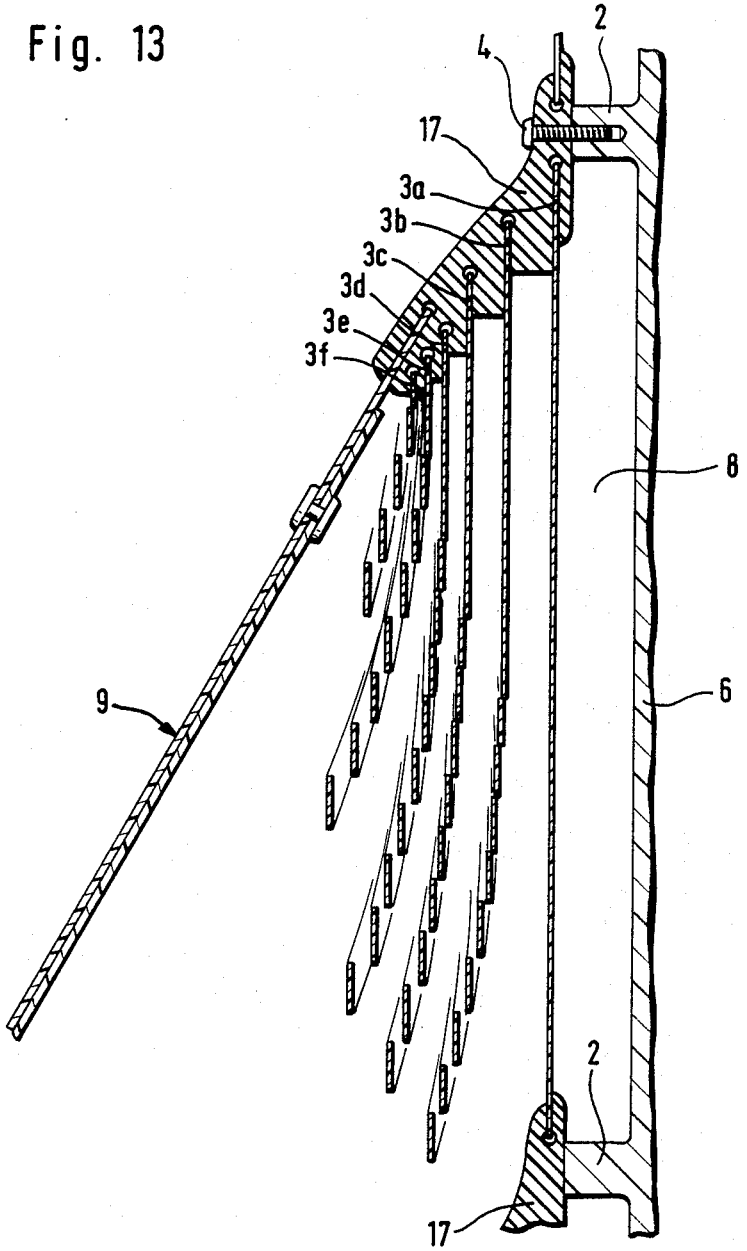
FIG. 13 is a schematic representation of a further shed attachment.

One means of maintaining sufficient air gap between sheds and to aid shed assembly is to mount all sheds in a silicone rubber extrusion (17) shown in FIG. 13. In this figure the central tube (6) is frustoconical and the extrusion (17) is attached to the ribbing (2), as before, by a bolt, screw (4) or similar means or directly by adhesive. A partially sealed volume (8) is created in this embodiment, as seen before in FIG. 10. The seal is incomplete at the top and bottom of the housing at which points the resulting gaps may be filled with polyurethane foam to provide an air filter.

Figure 14:
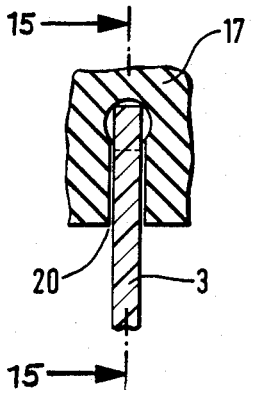
FIG. 14 shows an attachment detail of FIG. 13.
Figure 15:
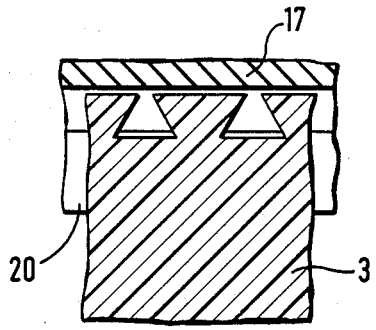
FIG. 15 is a cross-section along the line 15—15 of FIG. 14.

The extrusion (17) is made from either heat-cure or room temperature vulcanised rubber. Slots (20) in the extrusion provide holes into which the sheds are pushed as shown in detail in FIGS. 14 and 15.

The sheds (3) are retained by the extrusion (17) mechanically but may be further secured using a rubber caulk material to fill the space remaining in the support slots (20) after insertion of the sheds (3). Solidification or gelling of the caulk (if used) locks the sheds in position. The preferred caulking material is cold-cure silicone rubber.

Figure 16:
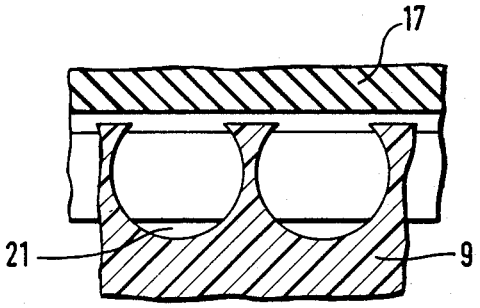
FIG. 16 shows an attachment detail similar to FIG. 15 but with the sheds cut differently.
Figure 17:
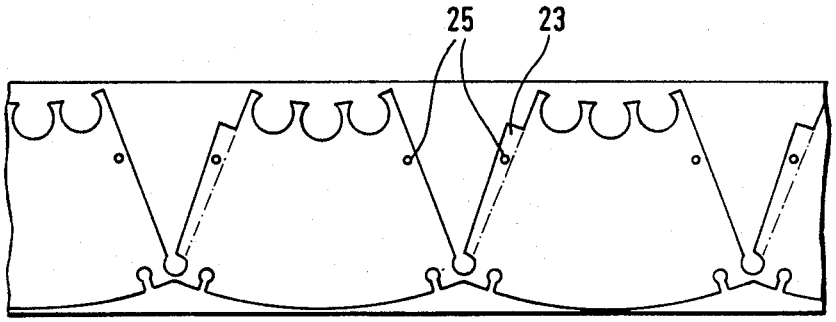
FIG. 17 shows a blank for use in manufacturing the water shed.

The water shed (9) is held in the same way, except for there being an air gap (21) at the shed base to avoid the puncture of the shed (FIG. 16). If thin sheets of polymeric material are used, it is possible to cut the shed from flat strips (FIG. 17) and fold the joins which may be held by one or two rivets through holes (25) in the overlapping portions (23).

Figure 18:
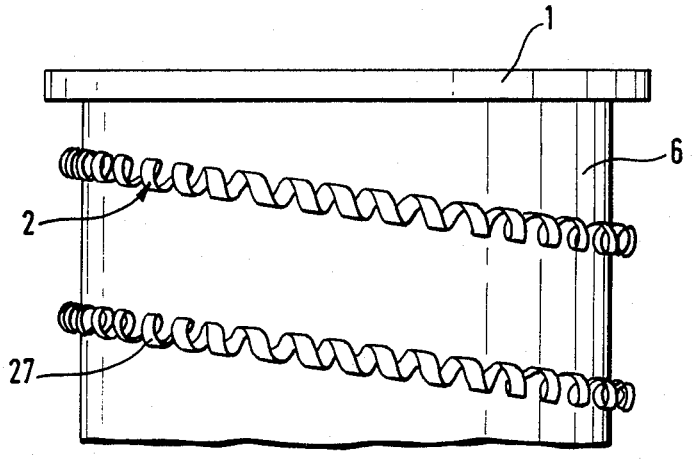
FIG. 18 shows one configuration of the ribbing.

The spiral ribbing (2) may itself be spiral in the form of a spiral strip (27) as shown in FIG. 18. In this case, the spiral strip (27) is made from a fibreglass rod impregnated with the same resin as the tube, by pultrusion onto a rotating cylinder.

By "pultrusion" in this context is meant the technique of passing a number of individual fibreglass strands from separate spools through a tank of liquid resin to coat or impregnate them and then pulling them through a die to compact them to the cross section desired whilst forcing out any resin surplus to that required to fill the interstices between the fibres. The curing of the resin may then be done by applying heat to the moving impregnated fibres in, and after passing through, the die for as long as it takes to produce a rigid or semi-rigid rod of diameter in the region of 1 to 2 mm. This uncured or semicured rod is still plastic and may be wound around a heated mandrel to form a spiral of resin bonded fibreglass when cured. If desired, the winding process may cause the rod to flatten into a "tape", i.e., a flat strip wound around the mandrel.

The spiral strip (27) thus formed has a spiral diameter preferably in the range from 5 to 40 mm, and is sufficiently flexible to wrap easily round the tube 96) to form the ribbing (2). The spiral strips (27) are prepared in sections and are initially held onto the tube (6) with tape and by plastic tubular plugs to join sections. The spirals (27) are permanently affixed by winding on resin impregnated glass fibre roughly at 90° to the spiral strip. The whole tube (including spiral strips) is then cured, the tape removed and the plugs cut out. The spiral strips (27) may then be further glued in position with a ridge (18) of resin or RBGF underneath to ensure that any water condensing on the tube is shed when drops reach the spiral strips (27).

Figure 19:
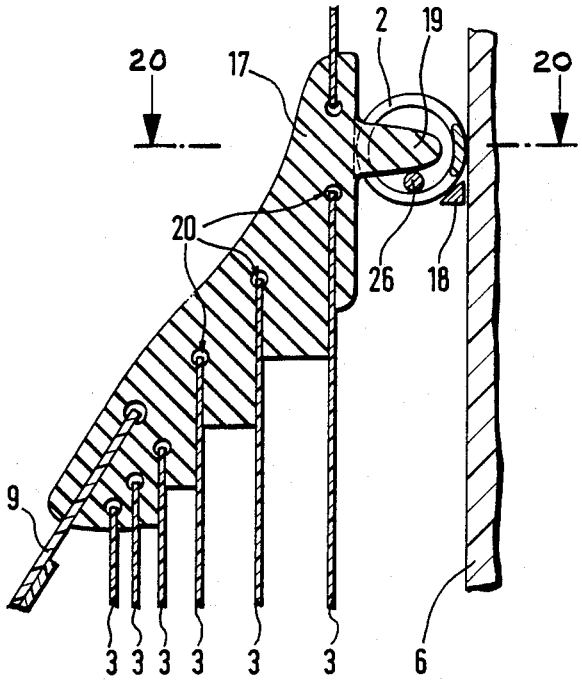
FIG. 19 shows details of a variation of the shed attachment shown in FIG. 13.
Figure 20:
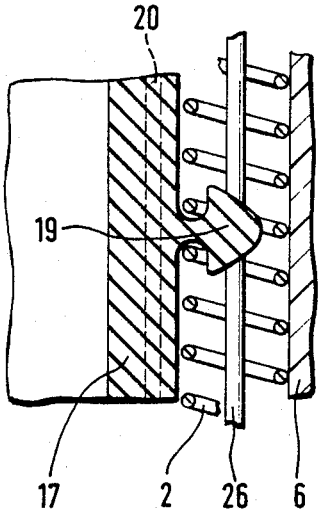
FIG. 20 is a cross-section along the line 20—20 of FIG. 19.

A portion of the rubber extrusion support means of FIG. 13 is shown in FIG. 19 but with a tapered peg (19) machined out of the extrusion moulding (17). The peg (19) passes between adjacent parallel strands (whorls) of the rod spiral (27) and is retained therein by its particular arrowhead shape - see FIG. 20 which is a cross-sectional view along the line 20—20 of FIG. 19.

For DC bushing housings in particular, it is advantageous to introduce a stress control element (26), see FIG. 19, to prevent high local stresses in the surrounding air and thus to reduce electrostatic deposition of pollution. Such pollution deposits themselves cause variable and localised areas of external stress which in turn lead to an undesirably large electrostatic deposit. This reciprocal effect is reduced by the setting up of a uniform field of electrical stress achieved by threading a strand (26) of resistive material through the spiral ribs (2), and connecting it electrically at each end of the housing to the flange (1) or to another convenient metallic ground. This arrangement minimises the risk of puncture of sheds from sparking, protects the resistive material from weather effects, and provides additional heating to the space (8) between the innermost shed and the tube, thus reducing relative humidity and condensation problems while also removing liquid water from the tube surface and from the innermost sheds.

The material forming the strand must be of high resistivity but need not be structurally strong since it is supported when in position. It is preferred that carbon-loaded plastic is used or one of the Raychem products.

EXAMPLE

In order to maintain the innermost sheds at 5° C. above ambient, and assuming a heat loss rate of $Q=0.2$ mW/° C./cm$^2$, for a 1 m long tube having a diameter of 500 mm and an overall working stress (i.e. voltage to be insulated) of 100kV$_{eff}$/m and a 1 start, 250 mm axial spacing shed set, a strand of resistance of $10^6\Omega$/cm is necessary and with a cross-section of 0.1–1 cm$^2$, a volume resistivity of $10^5$ to $10^6$ $\Omega$cm is needed. For a diameter of 1 m and a 2 start shed arrangement, an element having half these values (of resistance and resistivity) is required.

While there have been shown and described what are at present believed to be the preferred embodiments of the invention, it will be obvious to those skilled in the art that various changes and modifications may be made to them without departing from the scope of the invention as defined by the appended claims.

What is claimed is:

1. An insulator housing comprising:

(a) a resin bonded fibre tube having upper and lower ends;

(b) at least one set of inner sheds made up of strips of insulating, water repellent material attached around the tube in a spiral arrangement;

(c) at least one set of water sheds made up from strips of insulating, water repellent material attached around the tube in a spiral arrangement substantialy parallel to, and outside, the inner shed spiral arrangement, the water sheds extending obliquely downwards and outwards from the tube to form a continuous downward sloping surface, so as to shield the inner sheds from precipitation.

2. A housing according to claim 1, additionally comprising:

a conducting corona shield attached to the upper end of the tube.

3. A housing according to claim 1, wherein the tube is tapered to be wider at its upper end.

4. A housing according to claim 1, wherein the tube has flanges at both ends to allow fixation of either end to a flat surface.

5. A housing according to claim 4, additionally comprising:

a second tube identical to said first-mentioned tube, the flange at one end of said second tube being affixed to the flange at one end of the other tube such that the tubes are fixed end to end.

6. A housing according to claim 1, wherein two or more sets of inner sheds are arranged in a multi-start spiral arrangement.

7. A housing according to claim 1, wherein a lower portion of each strip of inner shed material is slotted.

8. A housing according to claim 1, wherein both the inner and water sheds are attached to the tube on ribs affixed spirally around the tube.

9. A housing according to claim 8, wherein the ribs comprise solid rods of resin bonded fibre.

10. A housing according to claim 9, wherein the inner sheds are attached to the ribs by securing means passing through regularly spaced holes in an upper portion of the inner sheds and into said ribs.

11. A housing according to claim 10, wherein the water sheds are attached to angled brackets themselves attached by securing means to said ribs.

12. A housing according to claim 11, wherein said resin bonded fibre is resin bonded glass fibre.

13. A housing according to claim 8, wherein the ribs comprise spiral strips of resin bonded fibre affixed spirally around said tube.

14. A housing according to claim 13, wherein said ribs contain a continuous element of electrically resistive material, said element having a first end and a second end each electrically connected to respective flanges on either end of said tube.

15. A housing according to claim 14, wherein both of said inner and water sheds are attached to said tube using a silicone rubber extrusion having retaining slots in which said sheds are inserted and held, and having pegs inserted in between adjacent whorls of said spiral strips.

16. A housing according to claim 15, wherein said resin bonded fibre is resin bonded glass fibre.

17. A housing according to claim 14, wherein said resin bonded fibre is resin bonded glass fibre.

18. A housing according to claim 13, wherein said resin bonded fibre is resin bonded glass fibre.

19. A housing according to claim 8, wherein said resin bonded fibre is resin bonded glass fibre.

20. A housing according to claim 1, wherein the water sheds are attached to angled brackets attached by securing means to said tube.

21. A housing according to claim 1, wherein said strips of material forming the water sheds are attached to each other by securing means passing through holes in overlapping regions of said water sheds.

22. A housing according to claim 1, wherein at least two sets of inner sheds are attached to said tube and wherein spacers are used at attachment points to maintain a gap between said inner shed sets.

23. A housing according to claim 22, wherein said spacers are strips of insulating polymeric material.

24. A housing according to claim 23, wherein said insulating polymeric material is selected from the group consisting of polypropylene, PTFE and silicone rubber.

25. A housing according to claim 1, having an innermost set of inner sheds and at least one other set of inner sheds, wherein the innermost set of inner sheds is attached at two points, one above the other, to create a partially sealed volume between said innermost inner shed set and said tube.

26. A housing according to claim 1, wherein said water repellent material is selected from the group consisting of PTFE and silicone rubber.

27. A housing according to claim 1, wherein said inner shed material is PTFE.

28. A housing according to claim 1, wherein said resin bonded fibre is resin bonded glass fibre.

* * * * *

UNITED STATES PATENT AND TRADEMARK OFFICE

CERTIFICATE OF CORRECTION

PATENT NO. : 4,833,278

DATED : May 23, 1989

INVENTOR(S) : Peter LAMBETH

It is certified that error appears in the above-identified patent and that said Letters Patent is hereby corrected as shown below:

Title page:

The assignee should be "Hydro-Quebec" as shown in the application as filed.

IN THE REFERENCE CITED:

The paper "Technical Problems Associated with Developing HVDC Converter Stations for Voltages Above 600kV" should be listed as --"IEEE Transactions on Power Delivery, January 1987, Volp. PWRD-2 No. 1, page 174"-- as shown in the application as filed.

IN THE CITATION FOR THE PUBLICATION:

"The Booster Shed: Prevention of Flashover of Polluted Substation Insulators in Heavy Wetting" should read --"IEEE Transactions on Power Apparatus and Systems"-- as shown in the application as filed.

AUTHOR OF THE PUBLICATION:

"Effect of Pollution on High-Voltage Outdoor Insulators" should be --"P.J. Lambeth"--.

IN THE BACKGROUND OF THE INVENTION:

Column 1, line 40, delete "electrostaticallydeposited" and insert --electrostatically deposited--;

line 63, delete "BUSINGS" and insert --BUSHINGS--;

Column 2, line 29, delete "HELICODAL" and insert --HELICOIDAL--; delete "LIES" and insert -- LINES--.

UNITED STATES PATENT AND TRADEMARK OFFICE

CERTIFICATE OF CORRECTION

PATENT NO. : 4,833,278

DATED : May 23, 1989

INVENTOR(S) : Peter LAMBETH

It is certified that error appears in the above—identified patent and that said Letters Patent is hereby corrected as shown below:

IN THE SPECIFICATION:

Column 7, line 13, delete "2" and insert --≃2--;

line 23, delete "regularly" and insert --frequently--;

line 29, delete " 96)" and insert --(6)--;

line 33, before "triple" insert --double,--;

Column 8, line 33, delete "a" and insert --α--;

line 53, delete "be" and insert --by--;

line 59, delete "frustoconical" and insert --cylindrical--.

Column 9, line 40, delete "96)" and insert --(6)--;

Signed and Sealed this

Thirty-first Day of July, 1990

*Attest:*

HARRY F. MANBECK, JR.

*Attesting Officer*

*Commissioner of Patents and Trademarks*